US005353941A

United States Patent [19]

Benvegnu et al.

[11] Patent Number: 5,353,941

[45] Date of Patent: Oct. 11, 1994

[54] ADJUSTABLE FLOATING ROOF SUPPORTS FOR REDUCED VAPOR LOSS

[75] Inventors: John A. Benvegnu, Spring; Reginald E. Edwards, Houston, both of Tex.; James M. Gleason, Horseheads, N.Y.; Joel D. McDaniel, Grant Park, Ill.

[73] Assignee: Chicago Bridge & Iron Technical Services Company, Oak Brook, Ill.

[21] Appl. No.: 67,233

[22] Filed: May 26, 1993

[51] Int. Cl.[5] ..... B65D 88/40

[52] U.S. Cl. ..... 220/220; 220/216; 248/351

[58] Field of Search ..... 220/216, 218, 220, 578; 248/351

[56] References Cited

U.S. PATENT DOCUMENTS

| | | | |
|---|---|---|---|
| Re. 29,270 | 6/1977 | Nelson | 220/220 |
| 2,536,077 | 1/1951 | Orr et al. . | |
| 2,538,032 | 1/1951 | Orr et al. . | |
| 2,586,856 | 2/1952 | Orr et al. . | |
| 2,847,755 | 8/1958 | Mummert et al. . | |
| 2,931,534 | 4/1960 | Wiggins | 220/220 X |
| 3,319,329 | 5/1967 | Knutsen et al. | 220/220 X |
| 3,587,911 | 6/1971 | Creith | 220/220 |
| 3,812,683 | 5/1974 | Laverman . | |
| 3,815,775 | 6/1974 | Strunc et al. . | |
| 4,243,151 | 1/1981 | Bruening . | |

FOREIGN PATENT DOCUMENTS

| | | | |
|---|---|---|---|
| 828558 | 12/1969 | Canada | 220/220 |

*Primary Examiner*—Allan N. Shoap
*Assistant Examiner*—Jes F. Pascua
*Attorney, Agent, or Firm*—Marshall, O'Toole, Gerstein, Murray & Borun

[57] ABSTRACT

This invention relates to a floating roof support for a liquid storage tank that reduces the loss of vapor from the tank and that supports the roof in a low and a high position.

13 Claims, 4 Drawing Sheets

ADJUSTABLE FLOATING ROOF SUPPORTS FOR REDUCED VAPOR LOSS

This invention relates generally to an adjustable support for a floating roof and specifically to a floating roof support for reducing vapor loss and supporting a floating roof in a low and high position above a tank bottom and for being suspended in an operating position when the roof is floating above the high position.

BACKGROUND OF THE INVENTION

Floating roof tanks are used throughout the world to store a variety of liquids, some of which emit pollution causing vapors which must be contained with the tank. Floating roofs require support above the tank bottom when the tank is not in service to provide clearance for piping and so that construction and maintenance crews can access the tank beneath the floating roof.

It is desirable to provide more than one roof support position. A low position, one to three feet above the tank bottom, is needed in many tanks due to piping or conduits that may be located near the bottom of the tank. A high position is desirable to permit access for workers to clean and repair the interior of the tank. A single high position does not permit the tank to function properly due to the accumulation of vapor in the tank when the liquid level falls below the high position.

Early floating roof supports functioned well as structural members but were typically expensive to manufacture and had openings through which vapors could escape from the tank. A variety of methods were employed to seal the openings that were unsatisfactory because they were expensive, unsightly, or prone to deteriorate when exposed to some tank vapors or sunlight.

It is the general object of this invention to provide a floating roof support for reduced vapor loss that is adjustable between a low position and a high position and is inexpensive to fabricate and install.

SUMMARY OF THE INVENTION

According to this invention a floating roof support for reducing tank vapor loss is provided. The roof support extends through and supports a floating roof in a low position and a high position above a tank bottom and it may be suspended by the roof when the roof floats above the high position. The roof support includes a substantially vertical long inner column having a lower end for bearing on the tank bottom; a substantially vertical short outer column defining a vertical bore in which the long inner column is disposed, the short outer column being slidable up and down relative to the long inner column between the low position and the high position, and having a lower end for bearing on the tank bottom in the low position; means for joining the floating roof to the short outer column at an elevation above the lower end to define a lower position; a seal plate joined to the top end of the short outer column, the seal plate having a hole through which the long inner column is slidably disposed; a cap plate joined to the top end of the long inner column; means for locking the seal plate to the cap plate for hanging the short outer column from the long inner column in the high position and the operating position if the roof floats above the high position; and a seal secured to the seal plate having a hole and an inner sealing surface in wiping engagement with the long inner column, the seal also having a bearing surface to engage the cap plate in the high or operating positions.

The roof support means for locking the seal plate to the cap plate may include first and second hangers joined to the seal plate on opposite sides of the seal plate hole and each having a substantially horizontal flange; and a locking bar joined to the cap plate for rotating under and engaging the flanges of the first and second hangers.

The locking means may include first and second C-shaped latches each having lower legs hinged to the short outer column and upper legs for bearing on the top of the cap plate.

Drainage ports may be provided in either or both of the inner and outer columns.

A floating roof support in accordance with the present invention may include a substantially vertical long inner column having a lower end for bearing on the tank bottom; a substantially vertical short outer column having a vertical bore in which the long inner column is disposed, the short outer column being slidable relative to the long inner column between the low position and the high position and having a lower end for bearing on the tank bottom in the low position; means for joining the floating roof to the short outer column at an elevation above the lower end to define the low position; a cap plate joined to the top end of the long inner column; means for locking the cap plate to the top end of the short outer column for hanging the short outer column from the long inner column in the high position; and a seal secured to the top end of the short outer column, defining a hole having an inner sealing surface in wiping engagement with the long inner column, the seal also having a bearing surface to engage the cap plate in the high position.

The means for locking the cap plate to the upper end of the short outer column may include a threaded outer annular surface near the upper end of the short outer column and a threaded inner annular surface on the bottom of the cap plate adapted to engage the threaded surface on the short outer column.

Or the locking means may include a threaded outer annular surface near the upper end of the short outer column and a thread cap having a threaded inner annular surface adapted to engage the threaded surface on the short outer column.

Finally, the locking means may include a downwardly extending sleeve formed integrally with the cap plate and surrounding the top end of the short outer column, the sleeve defining at least one dog-leg groove, and a lug joined to and extending outwardly from the upper end of the short outer column for being received in the dog-leg recess and bearing on a land in the recess.

DETAILED DESCRIPTION OF THE DRAWINGS

Figure 1:
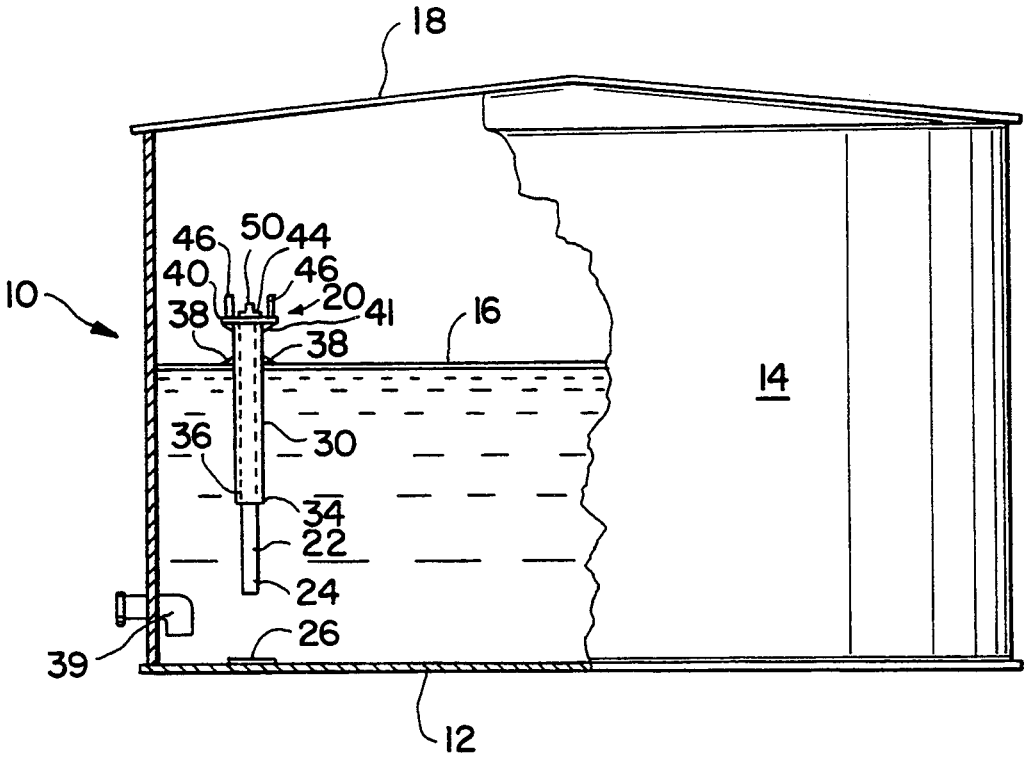
FIG. 1 is an elevational view, partially broken away and in section of a floating roof tank with a floating roof support in an operating position.

FIG. 1 illustrates a floating roof tank 10 having a tank bottom 12, side wall 14, and floating roof 16. An optional fixed roof 18 is also illustrated and is used where ice, snow and rain are problems or for other reasons. A floating roof support referred to generally at 20 is illustrated in an operating position (described more fully below). Only one support is illustrated, but any number of roof supports can be used in a tank depending on the tank size and the height at which the roof is supported.

The roof support 20 includes a long inner column 22, illustrated here as a pipe but it could be a tube, wide flange member, channel, or other structural shapes or combinations of shapes. The long inner column 22 has a lower end 24 for resting on the tank bottom 12. An optional bearing plate 26 will distribute the load of the column to minimize punching through the tank bottom 12 or excessive settlement of the roof support 20. A drainage port 27 is provided to allow liquid to escape from the long inner column 22 when it is bearing on the tank bottom 12.

Figure 2:
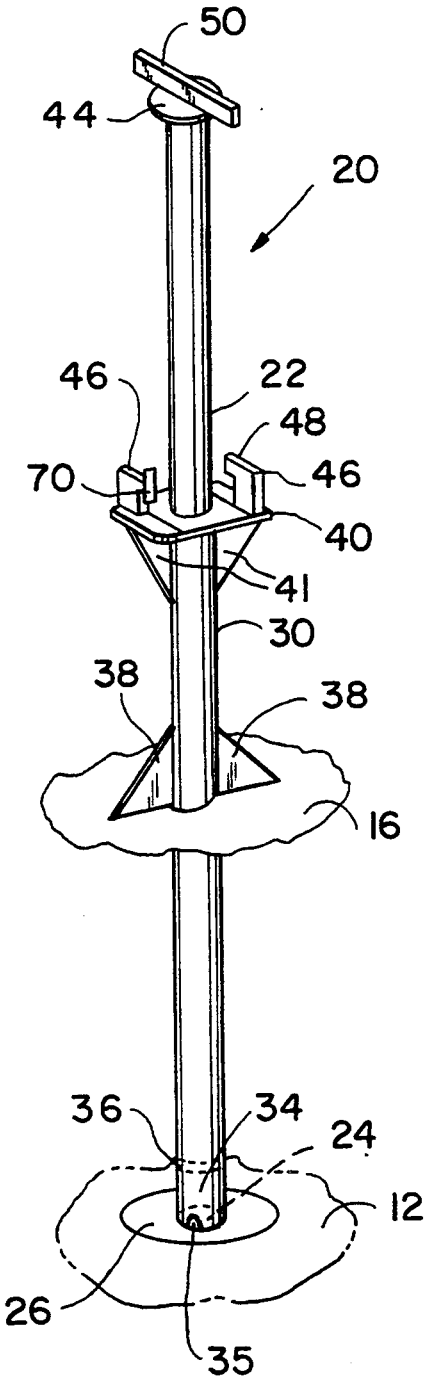
FIG. 2 is a perspective view of a floating roof support in the low position supporting a floating roof segment.
Figure 3:
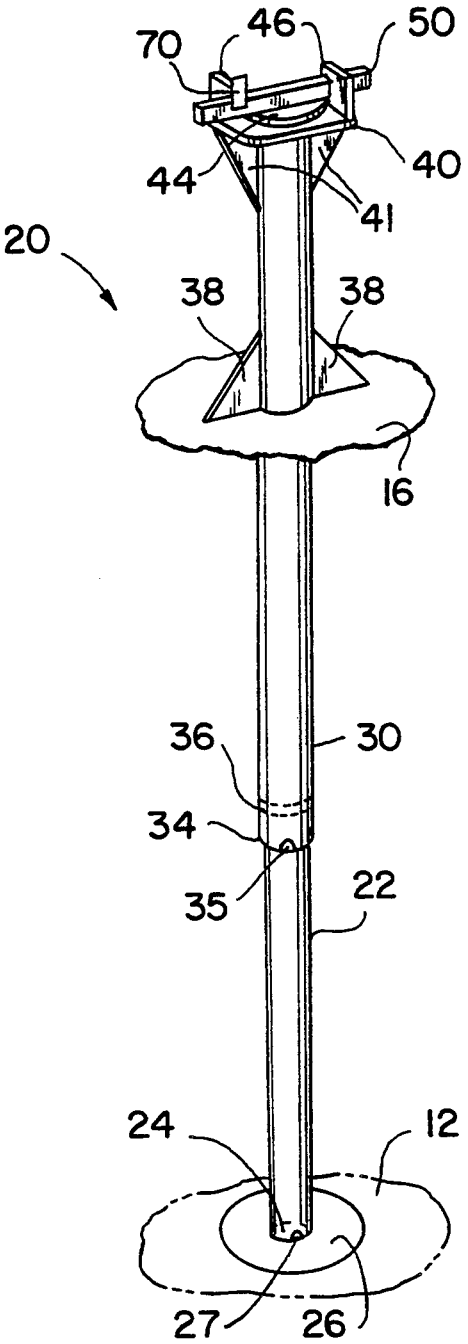
FIG. 3 is the floating roof support of FIG. 2 in the high position.

A short outer column 30 defines a bore 32 through which the long inner column 22 is disposed. The short outer column 30 is illustrated as a pipe and it is preferably a pipe two sizes larger than the pipe used for the long inner column 22. The outer column could also be a tube, welded channels, or some other shape which substantially surrounds the inner column 22. The short outer column 30 is slidable between the low position illustrated in FIG. 2 and the high position illustrated in FIG. 3 and also has a lower end 34 that is adapted to bear on the tank bottom 12 or the bearing plate 26. The short outer column 30 also has a drainage port 35 to release liquid entrapped when the lower end 34 is bearing on the tank bottom 12. An optional guide ring 36 (phantom lines in FIGS. 2 through 4) can be positioned in the bore 32 near the lower end 34 of the outer column 30 to maintain a substantially coaxial relationship with the long inner column 22 for smooth sliding and good seal contact (see below).

The short outer column 30 is joined to the floating roof 16 by any suitable means and in FIGS. 1 through 5 a pair of triangular gusset plates 38 are used that are welded to both the floating roof 16 and to the short outer column 30. The floating roof 16 is joined at an elevation above the lower end 34 of the short outer column 30 to define the low position illustrated in FIG. 2. This low position is necessary to prevent the floating roof 16 from dropping down on objects or residue in the tank bottom 12 such as pipe 39 extending through the tank wall 14, illustrated in FIG. 1.

As illustrated in FIGS. 2 through 5, a seal plate 40 is joined to the top end of the short outer pipe 30 using triangular gusset plates 41, or other suitable means. The seal plate has a hole vertically aligned with the bore 32 in the short outer column 30 so that the seal plate 40 and the short outer column 30 slide up and down over the long inner column 22.

A cap plate 44 is joined to the top end of the long inner column 22. The cap plate 44 can be locked to the seal plate 40 for hanging the short outer column 30 from the long inner column 22 to establish the high position illustrated in FIG. 3. This is possible because the floating roof 16 is also hanging from the long column 22 since it is joined to the short column 30.

A means for locking the seal plate 40 to the cap plate 44 is illustrated in FIGS. 1 through 5 and it includes first and second hangers 46 welded to the seal plate 40 on opposite sides of the hole. Each hanger has an integral horizontal flange 48 that are illustrated in opposing directions and diametrically aligned with one another.

A horizontal lock bar 50 is welded to the cap plate 44. The lock bar 50 is sized so that it can rotate under and engage the horizontal flanges 48 of the first and second hangers 46 by rotating the long inner column 22, clockwise 90°.

Figure 4:
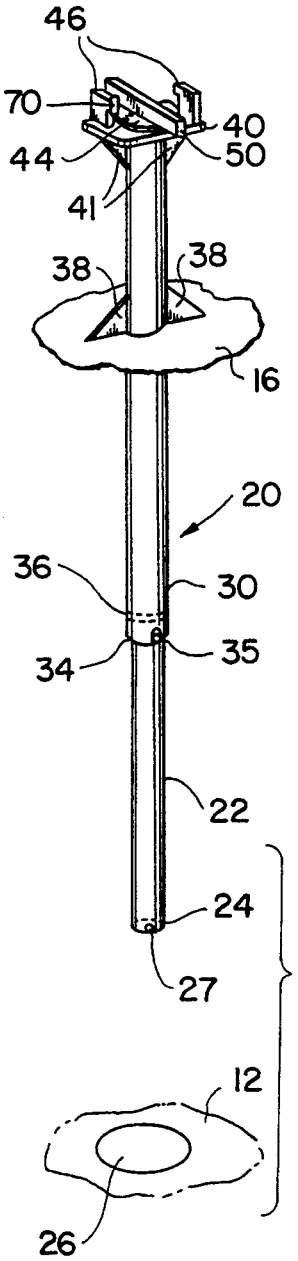
FIG. 4 is the floating roof support of FIGS. 2 and 3 suspending in the operating position when the roof floats above the high position.

FIG. 4 illustrates the floating roof support in an operating position which occurs when the floating roof 16 floats above the high position. When this occurs, the cap plate 44 prevents the short outer column 30 from sliding off the long inner column 22. Consequently, the entire floating roof support 20 is lifted off the tank bottom 12 or the bearing plate 26, if present, because the lower end 24 of the long column 22 is not fixed to the tank bottom 12.

Figure 5:
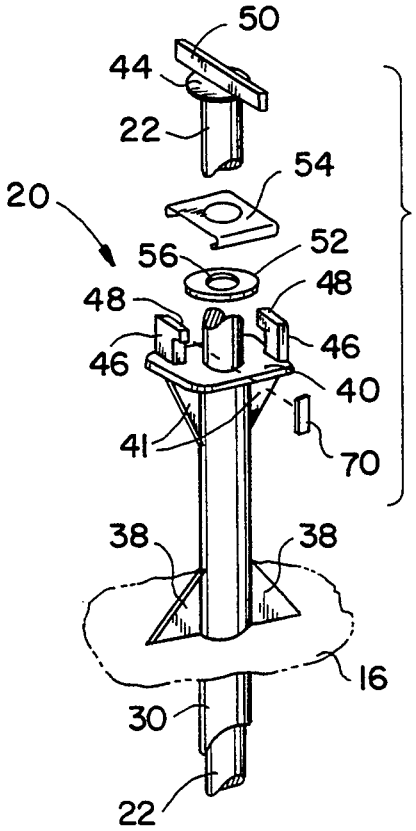
FIG. 5 is an exploded view of a locking mechanism for maintaining the roof support in the high position and a seal for reducing the loss of tank vapor through the support.

A seal 52 is illustrated in the exploded view of FIG. 5 that is secured to the seal plate 40 by any suitable means such as a clamp plate 54 that compresses the seal 52 and snap fits onto the seal plate 40. When assembled there is an inner annular surface 56 that is in wiping contact with the long inner column 22 to reduce the loss of vapor from the tank 10 from the space between the inner and outer columns. This wiping seal action is only necessary when the floating roof support is in the low position or on the way up to the high position.

Once in the high position, an upper bearing surface 62 of the seal 56 contacts the cap plate 44 to provide additional sealing protection. The upper bearing surface 62 of the seal remains exposed by the clamp plate 54 due to the larger diameter hole formed in the clamp plate 54 that does not cover the portion of the seal 52 adjacent the hole in the seal. This bearing surface 62 is in contact with the cap plate 44 when the floating roof support 20 is in the high or operational positions and functions as an efficient gasket that seals well and has a long useful life because the support 20 is in one of these positions most of the operational time of the tank 10. This arrangement of structural components satisfies the design load requirements of applicable safety codes (such as API Standard 650) and provides a floating roof support that efficiently reduces tank vapor loss and is less expensive to build than prior floating roof supports. Corrosion protection can be provided by galvanizing some or all of the components used in the roof support 20.

To operate the floating roof support 20 illustrated in FIGS. 1 through 5, the roof is originally in the low position (FIG. 2) where the lower end 34 of the short outer column 30 is bearing on plate 26 and is supporting the floating roof 16 above the tank bottom 12 to clear pipes 16 and other equipment or debris in the tank bottom 12.

When workmen require access to the interior of the tank 10, the roof support 20 is raised to the high position (FIG. 2) by lifting the short outer column 30 so that seal plate 40 is adjacent the cap plate 44. The long inner column 22 is then rotated clockwise 90° to engage the lock bar 50 and the first and second hangers 46. In the high position, workers have adequate headroom to clean or repair the interior of the tank 10.

It is desirable not to lock the floating roof support 20 in the high position when the tank 10 is storing water. While it presents no problem when the roof is at the high or operational elevations, one or more inadvertently locked roof supports 20 may punch through or damage the roof 16 when the level of liquid in the tank 10 falls below the high position because the roof 16 will tend to sag at unlocked roof supports 20.

Figure 5A:
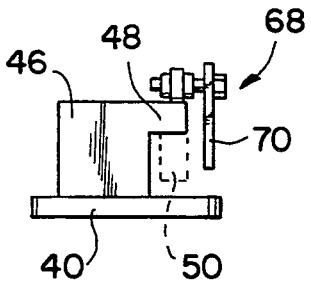
FIG. 5A is an elevational view of an antilocking device on a locking mechanism.

To prevent accidental engagement of the means for locking the seal plate 40 to the cap plate 44, means is provided that prevents engagement of the lock bar 50 and first and second hangers 46. The antilock mechanism 68 illustrated in FIG. 5A is preferably a normally closed mechanism for preventing the lock bar 50 from rotating under the horizontal flanges 48 including a stop bar 70 loosely bolted to the top of a horizontal hanger flange 48 at one end so as to hang in front of one of the horizontal flange. This arrangement permits an operator to swing the stop bar 70 above the horizontal flange to horizontally rotate the lock bar 50 under the hanger flanges 48 and then release the stop bar 70 for swinging-rotation downward. This mechanism is simple to construct and use, and provides adequate protection against accidental locking of the locking means.

Figure 6:
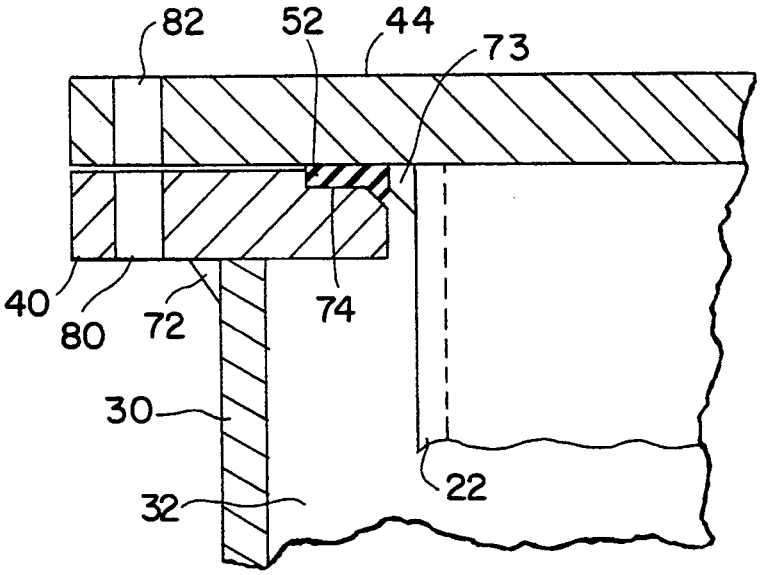
FIG. 6 is a partial sectional view of an alternate seal arrangement and means for locking the roof support in the high position.

FIG. 6 illustrates an alternate detail for the seal plate 40, the cap plate 44, and the means for locking them together. Short outer column 30 is illustrated in the high position with the long inner column 22 in the bore 32. The cap plate 44 is joined to the short outer column by a weld 72 and the cap plate 44 is joined to the long inner column 22 by a weld 73 which can be a continuous weld or a series spot welds.

The circumferential area adjacent the seal plate 40 hole is provided with a recess 74 to accommodate the seal 52 and the corner 76 of the recess 74 is chamfered to clear the cap plate weld 73. It can be seen from the figure that seal 52 and its inner annular surface must be resilient enough to accommodate the cap plate weld 73 when in the high or operating positions and to return to wiping engagement with the inner column 22 when the short outer column 30 drops below the high position. The seal 52 is preferably nitrile butadiene rubber. It can be adhesively secured in the recess 74 in this configuration or secured by a clamp plate 54 as describe above. It is also preferable to size the seal 52 so as to project above the recess 74 for uniform sealing engagement with the cap plate 44.

FIG. 6 also illustrates a bolt hole 80 in the seal plate 40 and a bolt hole 82 in the cap plate 44 that can be aligned by rotating the long inner column 22, and fitted with a bolt (not illustrated) as a means for locking the seal plate 40 to the cap plate 44 to hang the short outer column 30 from the long inner column 22. Additional bolt holes may be provided as needed for structural strength or ease of alignment.

Figure 7:
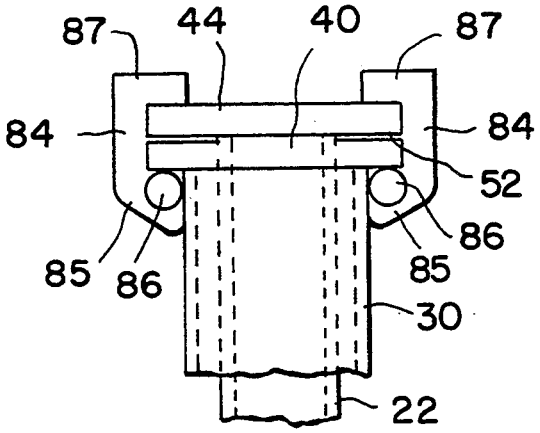
FIG. 7 is a partial elevational view of an alternate locking mechanism for maintaining the roof support in the high position.

FIG. 7 illustrates another means for locking the seal plate 40 to the cap plate 44. In this embodiment, first and second C-shaped clamps 84 are rotatably joined at their lower legs 85 to the short outer column 30 by hinges 86. The hinges 86 can be joined directly to the short outer column 30 or to the underside of seal plate 40 by any suitable means. To lock the plates together, the short outer column 30 is raised to bring the seal plate 40 adjacent the cap plate 44, and the C-shaped clamps are rotated upwardly to bring their top legs 87 into snug engagement with the top of the cap plate 44. This compresses seal 52 to reduce the loss of vapor from the tank 10.

Figure 8:
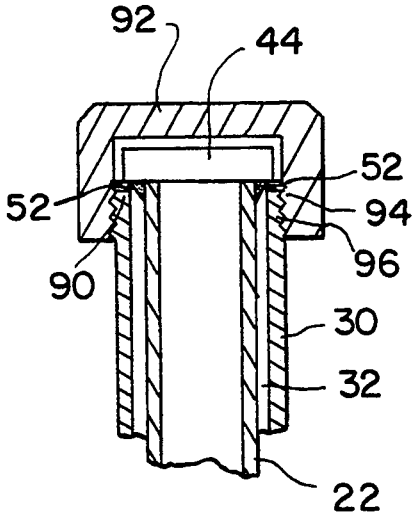
FIG. 8 is a partial sectional view of an alternate seal arrangement and means for locking the floating roof support in the high position.

FIG. 8 illustrates an alternate seal arrangement and locking means that omits the seal plate of the above-described embodiments. In this embodiment the cap plate 44 is positioned above and adjacent to the upper end 90 of the outer column 30 with the seal 52 compressed between the two by a threaded cap 92 having an inner annular surface 94 that is tapped to match threads 96 on the upper end 90 of the short outer column 30. This arrangement hangs the short outer column 30 from the long inner column 22 in both the high and operating positions.

Figure 9:
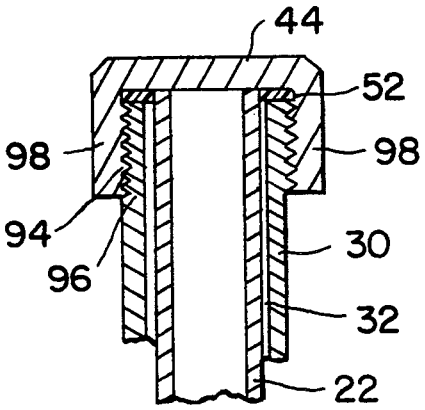
FIG. 9 is a partial sectional view of an alternate seal arrangement and means for locking the floating roof support in the high position.

The embodiment of FIG. 9 is similar to that of FIG. 8 except that the cap plate 44 is integrally joined with downwardly extending legs 98 that are tapped with threads 94 to match the threads 96 on the upper end 90 of the outer column 30.

Figure 10:
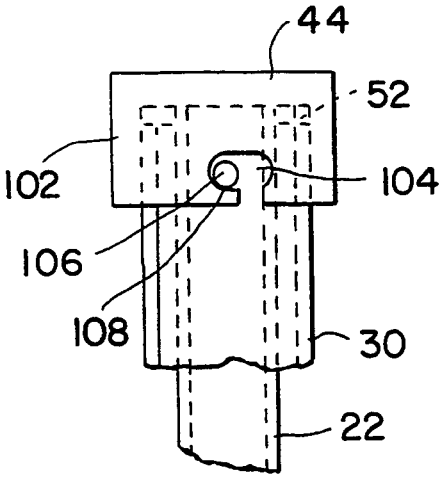
FIG. 10 is a partial sectional view of an alternate seal arrangement and means for locking the floating roof support in the high position.

FIG. 10 also illustrates a modified cap plate 44 that includes a sleeve 102 with a machined dog-leg groove 104 that engages a lug 106 when the lug 106 is slid upward into the groove 104 and the inner column 22 is rotated slightly so the lug 106 rests on a land 108 in the recess 104. A matching recess and lug arrangement may be provided on the opposite side of the floating roof support 20.

The foregoing detailed description has been given for clearness of understanding only, and no unnecessary limitations should be understood therefrom, as modifications will be obvious to those skilled in the art.

What is claimed is:

1. A floating roof support for reducing tank vapor loss, extending through and supporting a floating roof in a low position and a high position above a tank bottom, the floating roof support comprises:

a) a substantially vertical long inner column having a lower end for bearing on the tank bottom;

b) a substantially vertical short outer column defining a vertical bore in which the long inner column is disposed, the short outer column being slidable relative to the long inner column between the low position and the high position, and having a lower end for bearing on the tank bottom in the low position;

c) means for joining the floating roof to the short outer column at an elevation above the lower end to define the low position;

d) a seal plate joined to the top end of the short outer column, the seal plate defining a hole through which the long inner column is slidably disposed;

e) a cap plate joined to the top end of the long inner column;

f) means for locking the seal plate to the cap plate for hanging the short outer column from the long inner column in the high position; and g) a seal secured to the seal plate, defining a hole having an inner sealing surface in wiping engagement with the long inner column, the seal also having a bearing surface to engage the cap plate in the high position.

2. The floating roof support of claim 1 in which the means for locking the seal plate to the cap plate comprises:

a) first and second hangers joined to the seal plate on opposite sides of the seal plate hole and each having a substantially horizontal flange; and b) a locking bar joined to the cap plate for rotating under and engaging the flanges of the first and second hangers.

3. The floating roof support of claim 1 in which the means for locking the seal plate to the cap plate comprises first and second C-shaped latches each having lower legs hinged to the short outer column and upper legs for bearing on top of the cap plate.

4. The floating roof support of claim 1 in which the short outer column defines a drainage port loss near the lower end of the column.

5. A floating roof support for reducing tank vapor loss, extending through and supporting a floating roof in a low position and a high position above a tank bottom, and for being suspended in an operating position above the high position when the roof is floating, the floating roof support comprises:

a) a substantially vertical long inner column having a lower end for bearing on the tank bottom;

b) a substantially vertical short outer column defining a vertical bore in which the long inner column is disposed, the short outer column being slidable relative to the long inner column between the low position and the high position, and having a lower end for bearing on the tank bottom in the low position;

c) means for joining the floating roof to the short outer column at an elevation above the lower end to define the low position;

d) a seal plate joined to the top end of the short outer column, the seal plate defining a hole through which the long inner column is slidably disposed;

e) a cap plate joined to the top end of the long inner column to prevent the short outer column from sliding off in the operating position;

f) means for locking the seal plate to the cap plate for hanging the short outer column from the long inner column in the high position; and g) a seal secured to the seal plate, defining a hole having an inner sealing surface in wiping engagement with the long inner column, the seal also having a bearing surface to engage the cap plate in the high and operating positions.

6. The floating roof support of claim 5 in which the means for locking the seal plate to the cap plate comprises:

a) first and second hangers joined to the seal plate on opposite sides of the seal plate hole and each having a substantially horizontal flange; and b) a locking bar joined to the cap plate for rotating under and engaging the flanges of the first and second hangers.

7. The floating roof support of claim 5 in which the means for locking the seal plate to the cap plate comprises first and second C-shaped latches each having lower legs hinged to the short outer column and upper legs for bearing on top of the cap plate.

8. The floating roof support of claim 5 further comprising means for preventing the locking means from engaging while the support is in the operating position.

9. The floating roof support of claim 5 in which the short outer column defines a drainage port near the lower end of the column.

10. A floating roof support for reducing tank vapor loss, extending through and supporting a floating roof in a low position and a high position above a tank bottom, the floating roof support comprises:

a) a substantially vertical long inner column having a lower end for bearing on the tank bottom;

b) a substantially vertical short outer column defining a vertical bore in which the long inner column is disposed, the short outer column being slidable relative to the long inner column between the low position and the high position, and having a lower end for bearing on the tank bottom in the low position;

c) means for joining the floating roof to the short outer column at an elevation above the lower end to define the low position;

d) a cap plate joined to the top end of the long inner column;

e) means for locking the cap plate to the top end of the short outer column for hanging the short outer column from the long inner column in the high position; and f) a seal secured to the top end of the short outer column, defining a hole having an inner sealing surface in wiping engagement with the long inner column, the seal also having a bearing surface to engage the cap plate in the high position.

11. The floating roof support of claim 10 in which the means for locking the cap plate to the top end of the short outer column comprises:

a) a threaded outer annular surface near the upper end of the short outer column; and b) a threaded inner annular surface on the bottom of the cap plate, adapted to engage the threaded surface on the short outer column.

12. The floating roof support of claim 10 in which the means for locking the cap plate to the top end of the short outer column comprises:

a) a threaded outer annular surface near the upper end of the short outer column; and b) a threaded cap having a threaded inner annular surface adapted to engage the threaded surface on the short outer column.

13. The floating roof support of claim 10 in which the means for locking the cap plate to the top end of the short outer column comprises:

a) a downwardly extending sleeve formed integrally with the cap plate and surrounding the top end of the short outer column, the sleeve defining at least one dog-leg groove; and b) a lug joined to and extending horizontally outward from the upper end of the short outer column for being received in the dog-leg recess and bearing on a land in the recess.

* * * * *